US007654329B2

(12) United States Patent
Lindland et al.

(10) Patent No.: US 7,654,329 B2
(45) Date of Patent: Feb. 2, 2010

(54) DUAL-TYPE PLUG FOR WELLHEAD

(75) Inventors: Hans Jørgen Lindland, Sandnes (NO); Stein Følkner, Hosle (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 373 days.

(21) Appl. No.: 10/557,435

(22) PCT Filed: May 19, 2004

(86) PCT No.: PCT/NO2004/000151

§ 371 (c)(1),
(2), (4) Date: Oct. 10, 2006

(87) PCT Pub. No.: WO2004/104364

PCT Pub. Date: Dec. 2, 2004

(65) Prior Publication Data

US 2007/0074870 A1 Apr. 5, 2007

(30) Foreign Application Priority Data

May 22, 2003 (NO) ..... 20032330

(51) Int. Cl.
*E21B 29/12* (2006.01)

(52) U.S. Cl. ..... 166/368; 166/337; 166/116; 166/135; 166/86.1

(58) Field of Classification Search ..... 166/337, 166/339, 335, 368, 192, 116, 135, 86.1
See application file for complete search history.

(56) References Cited

U.S. PATENT DOCUMENTS 2,808,229 A 10/1957 Bauer et al.
3,242,991 A 3/1966 Johnson et al.
3,252,515 A * 5/1966 Donaldson et al. ..... 166/114
3,256,937 A 6/1966 Haeber et al.
3,554,281 A * 1/1971 Ecuer ..... 166/155
3,556,212 A * 1/1971 Vazquez et al. ..... 166/72
3,580,332 A * 5/1971 Dean et al. ..... 166/184
4,047,566 A * 9/1977 Duke ..... 166/285
4,164,980 A * 8/1979 Duke ..... 166/291
4,412,559 A 11/1983 Streich et al.
4,522,259 A * 6/1985 Akkerman ..... 166/237
4,651,818 A * 3/1987 Johnson et al. ..... 166/115
5,020,597 A * 6/1991 Braddick et al. ..... 166/291
5,240,081 A 8/1993 Milberger et al.
5,542,475 A * 8/1996 Turner et al. ..... 166/387
5,566,772 A * 10/1996 Coone et al. ..... 175/321
5,575,336 A 11/1996 Morgan
5,787,979 A * 8/1998 Giroux et al. ..... 166/177.4
5,868,204 A * 2/1999 Pritchett et al. ..... 166/368
5,884,706 A * 3/1999 Edwards ..... 166/335
5,954,134 A 9/1999 Longbottom
5,988,277 A * 11/1999 Vick et al. ..... 166/123
5,988,282 A * 11/1999 Jennings et al. ..... 166/348
5,996,697 A * 12/1999 Vick et al. ..... 166/386
6,050,339 A 4/2000 Milberger (Continued)

FOREIGN PATENT DOCUMENTS

EP 1 350 918 A2 10/2003
GB 2 192 921 A 1/1988
GB 2 361 726 A 10/2001

*Primary Examiner*—Thomas A Beach

(57) ABSTRACT

The invention concerns a dual-type plug to be used in a wellhead. The plug has a separate retrievable inner plug (50). Retrieving only the inner plug allows the use of lighter work-over equipment than if the whole plug (10) must be pulled.

7 Claims, 3 Drawing Sheets

U.S. PATENT DOCUMENTS 6,076,605 A * 6/2000 Lilley et al. ..... 166/368
6,109,353 A 8/2000 Edwards et al.
6,352,114 B1 3/2002 Toalson et al.
6,367,551 B1 * 4/2002 Fenton ..... 166/345
6,408,947 B1 6/2002 Cunningham et al.
6,547,008 B1 4/2003 Hopper et al.
6,547,009 B2 * 4/2003 Vick, Jr. ..... 166/368
6,719,059 B2 * 4/2004 Dezen et al. ..... 166/368
6,810,954 B2 * 11/2004 Garrett et al. ..... 166/77.51
7,025,132 B2 * 4/2006 Kent et al. ..... 166/87.1
7,069,988 B2 * 7/2006 Bartlett et al. ..... 166/86.2
7,128,157 B2 * 10/2006 Hoffman et al. ..... 166/305.1
7,143,830 B2 * 12/2006 Bartlett ..... 166/339
2003/0019632 A1 1/2003 Humphrey et al.
2003/0111228 A1 6/2003 Garrett et al.
2007/0289745 A1 * 12/2007 Richards ..... 166/339

* cited by examiner

DUAL-TYPE PLUG FOR WELLHEAD

FIELD OF THE INVENTION

The present invention relates to a plug for use in a subsea Christmas tree. The invention also relates to a method of intervention in a subsea well, using a plug according to the invention.

BACKGROUND OF THE INVENTION

When developing subsea oil and gas wells there are stringent demands to the control and containment of the well during all aspects of the work, be it drilling, production or later intervention. The needs for control of well pressure have lead to requirements for safe barriers in the well and/or the Christmas tree, both during production and during intervention work.

In a horizontal type Christmas tree the production tubing hanger is located within the vertical bore of the tree and includes a vertical tubing hanger bore and a horizontal passage which is aligned with the horizontal production outlet in the tree. The production control valves are located in the horizontal outlet. The tubing hanger passage extends above the production outlet to provide access to the well, and this passage must be closed off during production.

In a conventional Christmas tree, the tubing hanger is set in the wellhead and the production control valves are located in the vertical passage of the tree. The control valves function as barriers during normal production, and the tubing hanger includes means for setting a plug in its vertical bore in case the well must be closed down.

In many countries, rules require at least two barriers between the well and the environment. For example, in a horizontal completion the two barriers are set with one in the tubing hanger above the production passage and the other in the tree bore.

In U.S. Pat. No. 6,050,339 there is shown a horizontal Christmas tree of a type well known in the art. A first plug is set to close tubing hanger passage above the production outlet. An internal tree cap is set in the vertical bore of the tree above the tubing hanger. The tree cap has an axial bore in which a second plug is set. To gain access to the well, both plugs must be removed.

In U.S. Pat. No. 5,575,336 there is shown another type of a horizontal Christmas tree. As above a first plug is set in the tubing hanger. A tree cap is set in the tree bore above the tubing hanger. A ball valve is located in the tree cap passage. To gain access to the well a tool is run in to open the valve. Thereafter the plug can be removed. This can be done in one operation, thus saving a run.

During the lifetime of the well various types of work may be carried out to enhance production or to measure conditions in the well. To gain access to a living well a pressure containment device, containing a number of valves, must be connected to the well before the barriers can be removed. The pressure containment device ensures control over the well during the work. Depending on the type of the work, either a lubricator stack or a riser is connected to the pressure containment device.

Various parameters dictate the size and complexity of the equipment used during intervention, the main concern being the pressure control valves. One of the principal parameters is well pressure. Higher pressure ratings demand larger equipment. Another parameter is the nominal size of the equipment, related to the tool to be employed during intervention.

In recent years larger type completions have become the norm, with tubing sizes up to 9". The size of the intervention equipment has therefore also grown bigger, since the internal diameter of the pressure control valves and workover riser must be large enough to accommodate the correspondingly sized plug(s). At the same time, intervention tools have become smaller, down to perhaps 2" or less. Therefore the size of the plug(s) limits the scaling down of the equipment. This means that smaller equipment cannot be employed even if only small size tools are needed for the work in the well. For example, a standard type completion has a 6" tubing and therefore a 6" plug. The equipment must therefore be dimensioned with a nominal 6" bore even if the tool to be used is only 2" and could be run in on cable or wireline.

The size and weight of the equipment also influence the choice of the type of vessel used for well intervention, especially governing the load handling capabilities of the vessel. As an example, a complex operation like pulling the tubing requires a full blow out preventer and drilling riser, resulting in the need for using a large drilling rig that can handle this load. At the other end of the scale, a simple sensor can be run in on slickline or cable requiring only a small boat.

Reducing the size of the equipment can therefore reduce costs dramatically. As an example, if the equipment can be reduced to 4" nominal size, the weight can be reduced by more than 30% as compared with 6" equipment. This again allows smaller size vessels to be used and cut costs dramatically.

One method to redress this problem is to use smaller size plugs in the tree. However, this solution restricts the choice of intervention methods, and some types of intervention will not be possible or the tubing must be pulled to gain access to the well. Therefore, the preferred choice is to use the full size plugs, to retain the freedom of choice.

SUMMARY OF THE INVENTION

According to the invention, this and other problems are solved by designing a retrievable plug, according to the following claim, that contains at least a smaller plug within the main plug. With that, one can choose to pull only the inner plug or the whole plug assembly, as dictated by the need.

The plug according to the invention comprises a main or outer plug which includes a cylindrical housing that is adapted to the bore where the plug is going to be set. The plug further comprises a releasable locking devise for holding the plug in a fixed position relative to the bore, and a number of sealing devises for sealing the plug to the bore. The sealing devises may be a part of the main cylindrical housing or separate elements which are held in position by the plug. The sort of sealing devises necessary will depend on the working environment for the plug, like pressure, temperature, corrosivity etc.

The main cylindrical housing includes at least one bore comprising at least one inner separate retrievable plug. The inner plug is preferably arranged coaxially with the outer main plug. Alternatively it may be arranged asymmetrically in relation with the main plug. There may also be more than one inner separate retrievable plug, for instance two arranged coaxially within each other.

The inner plugs have releasable locking devises and are equipped with sealing devises. These locking and sealing devises may be different or similar to the locking devised for the main plug. It might in some cases be favourable to have the same systems to be able to use the same tool for either retrieving the main plug with the inner plugs or only one of the inner plugs. In other cases may it be favourable due to available space to have different locking and sealing devises in the different plugs, since the main plug has a larger dimension than the inner plugs.

The main plug may comprise locking devises that cooperate with grooves in the bore where it is supposed to be set. This may also be the case for the inner plug by shaping the bore in the main cylindrical housing so that it corresponds with the locking devises for the inner plug.

The plug according to the invention is especially suitable to a part of a Christmas tree for an oil and/or gas well for one or both of the required barriers towards the environment for a well. The plug according to the invention may be set in the tubing hanger and/or in the tree cap as necessary and, while the plug is especially useful for horizontal type trees it can also be used with any conventional trees.

The plug according to the invention may be used anywhere in the well bore where such functionality is desired. For example the plug can be set in the well tubing in deep wells where several tubing strings are employed and where the topmost tubing have a larger diameter.

In the method for intervention in a well with a plug according the invention one may employ the tool adapted to retrieve the plug with the inner plug or only the inner plug through the riser, dependent on the size of the tools which should be used to perform the intervention work. This gives benefits both in need for equipment and risk during intervention work.

The invention will in the following be explained with a preferred embodiment which is one not limiting example of how the invention may be employed, with reference to the drawings.

DESCRIPTION OF THE PREFERRED EMBODIMENTS

Figure 1:
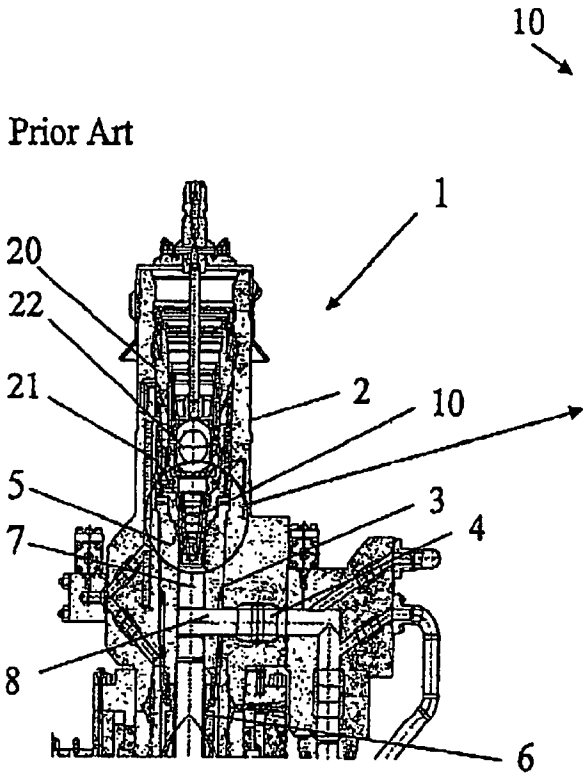
FIG. 1 is a vertical section through a Christmas tree of a known type.

In FIG. 1 there is shown a Christmas tree of a type that is well known in the art. This Christmas tree is shown for illustration purposes only, and it should be understood that many types of Christmas trees with various configurations and designs exist and can be used with the invention. Therefore only the main components of the Christmas tree will be described, since such designs must be considered well known for persons skilled in the art.

Christmas tree 1 includes a main housing 2 with a central bore 3 and a horizontal production outlet 4. A tubing hanger 5 is locked in bore 3 with tubing 6 extending downwardly therefrom to a production zone in the well. The tubing hanger has a bore 7 axially aligned with the tubing and with the same internal diameter. The tubing hanger includes horizontal passage 8 extending from the bore of the tubing hanger to the outside of the hanger.

When installing the tubing hanger with the tubing in the well, the tubing hanger is oriented in the tree such that its horizontal passage 8 aligns with the tree production outlet 4. Production fluid from the well is conveyed through tubing 6 and outlet 4 and to a manifold in the known manner.

After completion of the well, the part of bore 7 located above passage 8 is closed off with a plug 10. The plug is retrievably set using a suitable tool (not shown) with the help of latching dogs designed to interface with a groove in the wall of bore 7, as will be explained in more detail later.

An internal tree cap 20 is set in the tree bore 3 above the tubing hanger. The tree cap has an internal bore 21 in which is located a ball valve 22. The ball valve is normally closed but can be opened using a suitable tool (not shown).

Alternatively, a second plug can be set in tree cap bore 21, for example as shown in U.S. Pat. No. 6,050,339.

Figure 2:
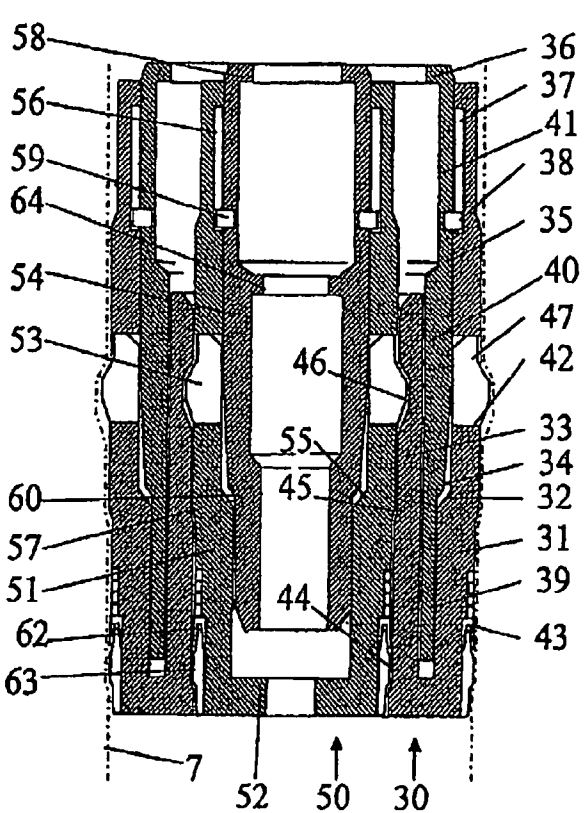
FIG. 2 is a vertical section through a plug according to the invention.

FIG. 2 shows a plug 10 according to the invention. The plug 10 comprises a main or outer plug 30 which forms a sliding fit within bore 7 in the tubing hanger. The main plug 30 includes outer cylindrical housing 31 and inner cylindrical housing 33, the inner housing being of shorter length than the outer housing. The outer and inner cylindrical housings define between them an annular space. A sealing devise in the form of a seal 43 is located around the outer surface of the plug 30, to seal between plug 30 and bore 7 when the plug is set. Outer housing 31 has a number of regular spaced openings 42 extending radially through its wall. In the openings are located the locking devises, in this embodiment in the form of locking dogs 47 that are held in a normally retracted position but can be made to extend radially to interface with a groove (not shown) in the tubing hanger bore 7. The inner wall of outer housing 31 has an upwardly facing shoulder 32. Inner wall of outer housing 31 is, along part of its upper end, machined out to form a circumferential slot 37.

Inner cylindrical housing 33 has an inner surface with a lower part machined to form a seal surface 44, an upward facing shoulder 45 and a ring groove 46.

A locking sleeve 35 is mounted for axial movement in the plug in the annular space between the outer 31 and inner 33 cylindrical housings. A downward facing shoulder 34 on the sleeve engages with shoulder 32 to act as a stop. Shoulder 34 divides locking sleeve 35 into a lower part 39, middle part 40 with a greater outer diameter and upper part 41. Upper part has an inward facing flange 36. Also, in the outer surface of the upper part 41, a radial groove is machined out and a ring 38 is located in the groove. The ring 38 protrudes outwards from locking sleeve to slide in slot 37. This, together with shoulder 34 acts as a limit for upward and downward movement of locking sleeve 35.

Alternatively, the slot 37 may be a number of radially displaced axial grooves and ring 38 a number of protruding pins. This will prevent the locking sleeve from rotating but allows axial movement between the lower position shown in FIG. 2 and an upper position (not shown).

When locking sleeve 35 is in its lower position as shown in FIG. 2, the middle part 40 pushes the locking dogs 47 outwards to engage with a ring groove in tubing hanger bore 7. Using a suitable tool to engage with flange 36, the locking sleeve can be pulled upwards. When this happens, locking dogs 47 will move out of engagement with middle part 40 and into engagement with lower part 39. The locking dogs 47 are now free to move into their retracted position. The plug 30 can now be pulled out from engagement with the tubing hanger bore 7.

An inner plug 50 is shown positioned co-axially within main plug 30. Inner plug 50 is cup-shaped, with cylindrical part 51 and bottom 52. Inner plug 50 forms a sliding fit within main plug 30. Cylindrical part 51 has an outer wall with a downward facing shoulder 57 and a number of regularly spaced radial openings in which corresponding locking dogs 53 are positioned. The inner wall of cylindrical part 51 has an upward facing shoulder 55. At its upper end a slot 56 of the same construction as slot 37 is machined. At the lower end of the inner plug 50 are located seals 62 to seal against the surface 44 of main plug 30. The seals 62 are held in place on the cylindrical part 51 by an annular seal retainer 63. Locking dogs 53 are held in a normally retracted position but can be made to extend radially to interface with groove 46 in inner wall of plug 30. A rocking sleeve 54 is mounted within cylindrical part 51. Locking sleeve has a downward facing shoulder 60 that abuts against shoulder 55. At its upper end locking sleeve 54 has an inward facing flange 58 and a circumference groove in which a ring 59 is mounted. The ring 59 slides in slot 56 to limit the axial movement of the locking sleeve 54. The locking sleeve 54 is thus movable between a lower position (as shown in FIG. 2) with shoulder 55 acting as a stop, and an upper position (not shown). When locking sleeve 54 is in the position shown in FIG. 2, the sleeve will force the dogs 53 outwardly into engagement with groove 46. The inner plug 50 is now locked within plug 30. Using a suitable tool acting on flange 58 the locking sleeve 54 can be moved upwards to allow locking dogs 53 to retract from groove 46. The inner plug 50 is now unlocked from main plug 30 and can be retrieved separately from the main plug.

Inner plug 50 can be equipped with means for engaging a fishing tool, for example profiles 64 as shown in FIG. 2.

Where there are two plugs in the tree, the upper plug in the tree cap can be designed so that its inner plug is slightly larger than inner plug 50. After removing inner plug in the upper plug, the inner plug of the lower plug can then be removed through the upper plug without the need for removing the whole upper plug.

Figure 3:
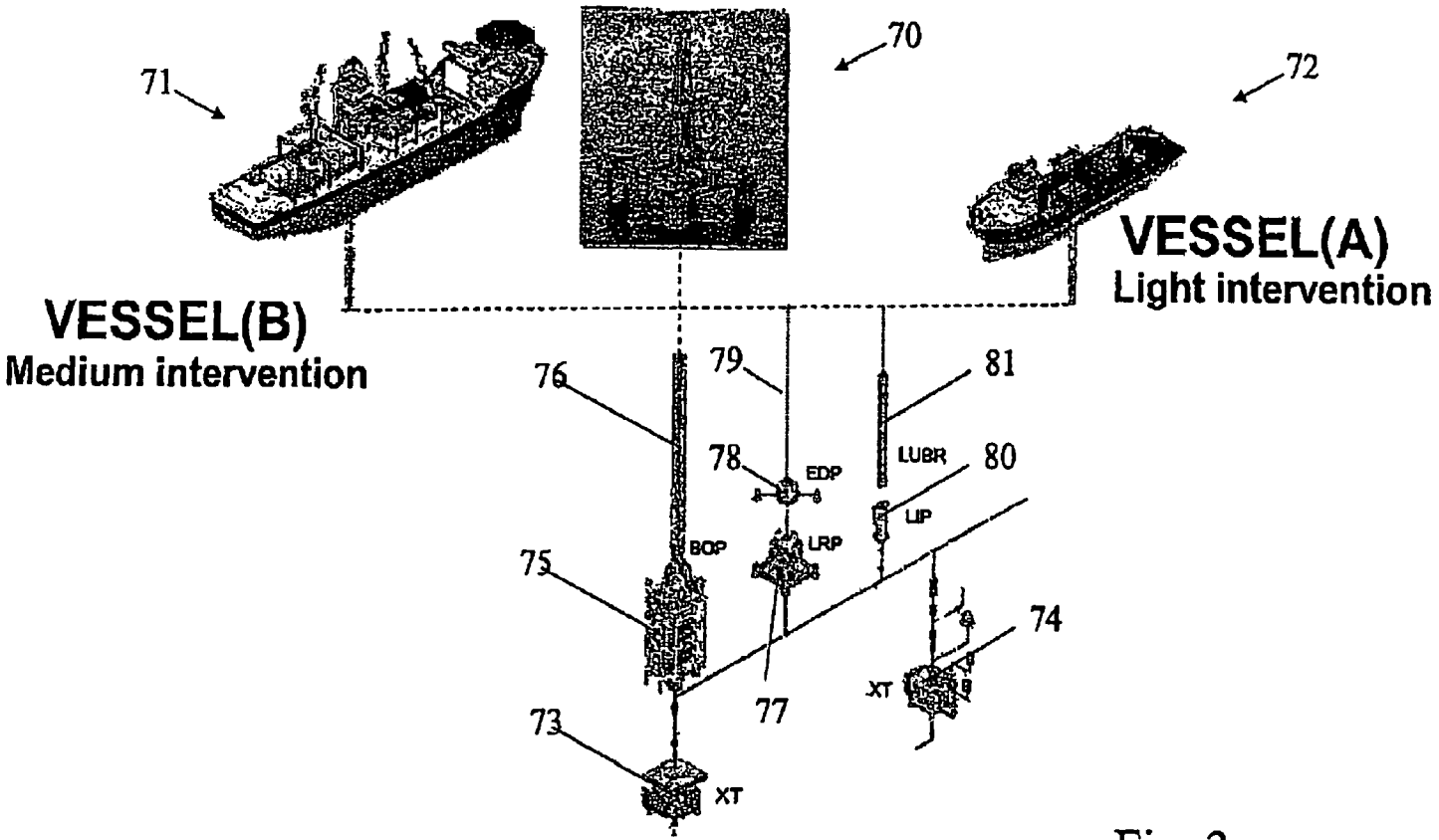
FIG. 3 is a schematic drawing showing various intervention methods.
Figure 4:
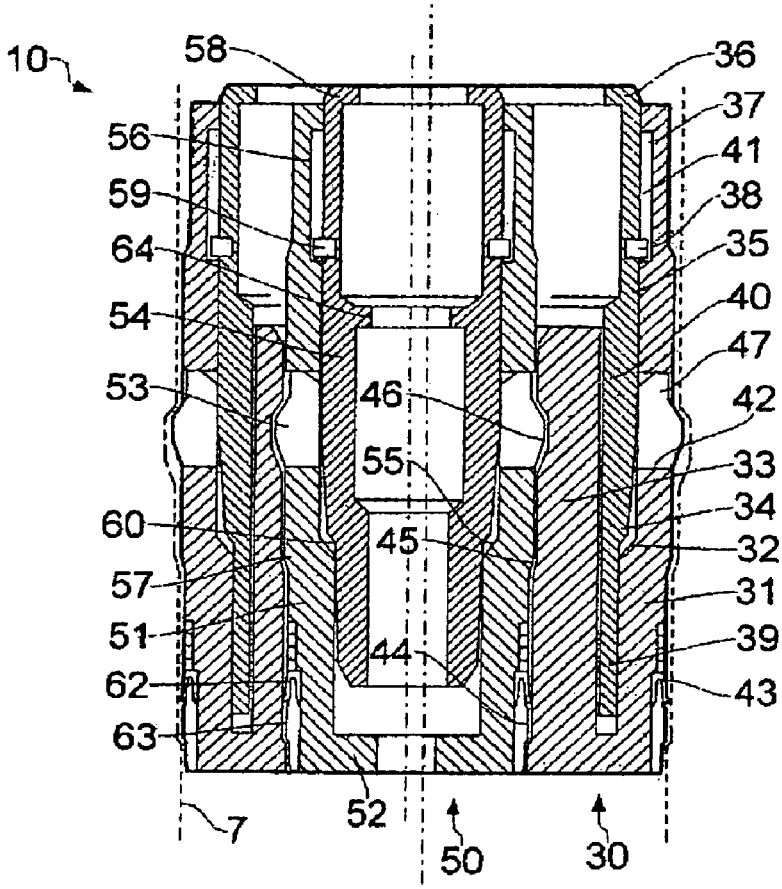
FIG. 4 is a vertical section through a second embodiment of a plug according to the invention.

In FIG. 3 examples of various equipment used for subsea intervention work are shown. The drawing is for illustrating purposes only, and only to show examples of the types of equipment commonly used for intervention and workover operations since there exist many variations of equipment of each type.

Three types of vessels are shown, a full drilling or intervention rig 70, an intermediate boat-type vessel 71 and a relatively small boat 72. The rig 70 is used for heavy intervention type work, having full facilities for all types of intervention work, and would include a tower hoist system, heave compensation system, storage space for risers, drillpipe and blowout preventers (BOP), and so on. The intermediate vessel 71 may also be equipped with tower hoist systems capable of running drillpipe, but will normally be used for coil tubing operations and smaller workover risers or wireline work, and does not have the large handling capacity of the rig. This type of vessels is normally held in position with dynamic positioning (DP) systems. The small vessel 72 has limited handling capacity and is therefore restricted in the type of work and in what weather conditions it can be used and will normally only be used to run equipment on wireline, cable or slickline. This type of vessel is only equipped with cranes.

Three types of intervention are also illustrated. The equipment shown can be connected to a Christmas tree that can either be a conventional 73 or horizontal 74 Christmas tree. Different designs are taken care of by using adapters between the XT and workover equipment.

One type of intervention requires a BOP 75 running on riser 76. The riser can be either 20" or 14" as necessary. The tools are normally run in by drillpipe. Since both BOP and risers are very heavy equipment, a heavy rig is normally employed. The second type of intervention uses a pressure control device commonly called a Lower Riser Package (LRP) 77. Between a workover riser 79 and the LRP 77 is located an Emergency Disconnect Package (EDP) 78. Well tools are normally run in with coil tubing or wireline. There are several sizes of this type of equipment, dictated by the size of the tubing and the type of work. In the third type the pressure control device is commonly called a Lower Intervention package (LIP) 80 to which is attached a lubricator 81. Well tools are run in on cable or wireline and the lubricator is used to gain control access to the well.

As the weight of the equipment increases, the vessel must be able to handle the loads. Especially critical is the passage of the equipment during the splash zone, but limitations are also imposed on the vessels capability of handling the equipment in heavy seas.

This invention is specially suited to work requiring a workover riser. Several types exist, with nominal sizes 7", 6" or 5". As previously indicated, the nominal size dictates the size of the other equipment, e.g. the pressure control valves in the LRP. A reduction in size from 6" to 5" riser may result in a weight saving of more than 30%. It is therefore important to choose the right size of the equipment for the work to be done, since this increases the number and choice of vessels capable of handling the work.

To gain access to the well, the pressure control assembly (LRP) is first connected to the Christmas tree. Then the workover riser and EDP are connected to the LRP. A second pressure control assembly (surface BOP) is attached to the top of the workover riser. A tool is run in to remove the entire plug 10 to open the well. If only smaller tools are scheduled to be used during intervention, a smaller LRP and workover riser can be used. A tool is run in to engage with flange 58 to pull the inner plug 50 from the main plug 30.

The method of the invention therefore allows for a wider choice of both equipment and vessels and allows the equipment to be more specifically tailored to the work. When work is planned in a well, it will first be analysed what type of work is necessary. If only small tools are to be used, the choice of workover equipment will be chosen accordingly and a suitable vessel commissioned. After connecting the equipment to the well, a tool is run in to release and retrieve the plug. If the job is light, only the inner plug will be retrieved through the smallbore riser. The work in the well is completed and the equipment disconnected from the well. If it is desired to use larger tools, again a suitable size of workover riser and vessel is chosen. After connecting to the well, a tool is run in, this time to retrieve the main plug, allowing larger tools to be run into the well.

The invention claimed is:

1. A retrievable plug for closing a bore in a well comprising:

a main plug which includes a cylindrical housing, a number of first releasable locking devices for holding the housing in position within the bore and means for sealing between the housing and the bore; and at lest one inner plug which is releasably mounted in the housing;

wherein the inner plug may be retrieved separately from the main plug; and wherein the inner plug is arranged off center in relation to a center axis of the main plug; and wherein the well comprises a Christmas tree and the bore comprises a vertical passage which extends through a tree cap mounted in or on the Christmas tree.

2. A retrievable plug for closing a bore in a well comprising:

a main plug which includes a cylindrical housing, a number of first releasable locking devices for holding the housing in position within the bore and means for sealing between the housing and the bore; and at lest one inner plug which is releasably mounted in the housing;

wherein the inner plug may be retrieved separately from the main plug;

wherein the inner plug is arranged off center in relation to a center axis of the main plug; and wherein the well comprises a Christmas tree and the bore comprises a vertical tubing hanger bore which extends through a tubing hanger mounted in the Christmas tree.

3. In combination with a Christmas tree which includes a central bore and a tree cap which is mounted in or over the central bore, the tree cap comprising a vertical passage extending therethrough, the improvement comprising a plug for sealing the vertical passage, the plug comprising:

a main plug which includes a cylindrical housing that is releasably mountable in the vertical passage; and at lest one inner plug which is releasably mountable in the housing;

wherein the main plug and the inner plug may be installed and retrieved together or the inner plug may be installed and retrieved independently of the main plug.

4. In combination with a Christmas tree which includes a central bore and a tubing hanger which is mounted in the central bore, the tubing hanger comprising a vertical tubing hanger bore extending therethrough, the improvement comprising a plug for sealing the tubing hanger bore, the plug comprising:

a main plug which includes a cylindrical housing that is releasably mountable in the tubing hanger bore; and at least one inner plug which is releasably mountable in the housing;

wherein the main plug and the inner plug may be installed and retrieved together or the inner plug may be installed and retrieved independently of the main plug.

5. A retrievable plug for closing a bore in a well comprising:

a main plug which includes a cylindrical housing, a number of first releasable locking devices for holding the housing in position within the bore and means for sealing between the housing and the bore; and at lest one inner plug which is releasably mounted in the housing;

wherein the inner plug may be retrieved separately from the main plug; and wherein the inner plug is arranged off center in relation to a center axis of the main plug.

6. A method for well intervention in a well comprising a Christmas tree and at least one plug which is located in the Christmas tree, the plug including a main plug and at least one inner separately retrievable plug, the method comprising:

connecting a subsea lubricator or workover riser to the Christmas tree;

retrieving either the inner plug or both the main plug and the inner plug through the riser; and performing the intervention;

wherein the plug is located in a vertical passage which extends through a tree cap that is mounted in or on the Christmas tree.

7. A method for well intervention in a well comprising a Christmas tree and at least one plug which is located in the Christmas tree, the plug including a main plug and at least one inner separately retrievable plug, the method comprising:

connecting a subsea lubricator or workover riser to the Christmas tree;

retrieving either the inner plug or both the main plug and the inner plug through the riser; and performing the intervention;

wherein the plug is located in a vertical tubing hanger bore which extends through a tubing hanger that is mounted in the Christmas tree.

* * * * *